United States Patent [19]

Bonfilio

[11] 4,227,542

[45] Oct. 14, 1980

[54] COLLAPSIBLE SHELTER

[76] Inventor: Paul Bonfilio, 47-25 198 St., Flushing, N.Y. 11358

[21] Appl. No.: 919,635

[22] Filed: Jun. 27, 1978

Related U.S. Application Data

[63] Continuation-in-part of Ser. No. 783,250, Mar. 31, 1977, Pat. No. 4,098,281.

[51] Int. Cl.[2] ..... A45F 1/16

[52] U.S. Cl. ..... 135/4 R; 135/DIG. 1; 135/5 R

[58] Field of Search ..... 135/DIG. 1, 4 R, 5 R, 135/7.1 R

[56] References Cited

U.S. PATENT DOCUMENTS

| | | | |
|---|---|---|---|
| 720,709 | 2/1903 | Lawrenz | 135/5 R |
| 2,006,655 | 7/1935 | Roth | 135/7.1 R |
| 2,266,853 | 12/1941 | Dabney | 135/5 R |
| 3,386,456 | 6/1968 | Walker | 135/DIG. 1 X |

FOREIGN PATENT DOCUMENTS

| | | | |
|---|---|---|---|
| 574681 | 4/1959 | Canada | 135/DIG. 1 |

*Primary Examiner*—C. J. Husar
*Assistant Examiner*—Conrad Berman
*Attorney, Agent, or Firm*—Allison C. Collard; Thomas M. Galgano

[57] ABSTRACT

A collapsible shelter includes a central hub, a multiplicity of ribs, pivotably secured and extending radially outwardly from the hub, and a covering material secured to each of the ribs and interconnecting adjacent ones thereof. The ribs of the shelter are movable between an open position in which they are spread apart in a fan-shaped pattern and a closed, collapsed position in which the ribs are disposed closely adjacent one another. The shelter also includes locking means for releasably securing the ribs in an open position. The shelter is especially suitable for use on the beach, swimming pool decks, terraces, and the like.

11 Claims, 8 Drawing Figures

10
11
12
13
14
15
16
17
20
20'
25
26
30
40
41
41'
42
50

COLLAPSIBLE SHELTER

This is a continuation-in-part, of application Ser. No. 783,250, filed Mar. 31, 1977 (now U.S. Pat. No. 4,098,281).

This invention relates to a collapsible shelter and, more particularly, to a collapsible shell which is especially suitable for use on the beach, swimming pool decks, terraces, and the like.

Collapsible shelters, such as beach umbrellas, and the like, used to provide protection against the sun at beaches and other recreational areas are, of course, well known in the art. However, these prior art structures have tended to have certain drawbacks. Some do not afford adequate sun and wind protection. Others do not provide sufficient privacy. Moreover, shelters of the roll-bar type, which open in a manner similar to a buggy top, are cumbersome to carry, quite heavy and relatively difficult to set up.

While attempts have been made to improve upon the above-noted deficiencies, so far as is known, no presently available collapsible shelter affords the advantages of that of the present invention, nor deals with these problems in a relatively simple and effective manner.

Accordingly, it is an object of the present invention to provide a novel collapsible shelter which affords privacy and protection against the wind and sun.

It is also an object of the present invention to provide such a shelter which is lightweight, portable and easy to install.

It is a further object of this invention to provide such a shelter which is of relatively simple design, inexpensive, durable and reliable in operation.

It is a more particular object of this invention to provide a novel shelter having the foregoing attributes and characteristics which is especially suitable for use on the beach, swimming pool decks, terraces, and the like.

It has now been found that certain of the foregoing and related objects are readily attained in a collapsible shelter which includes a central hub and a multiplicity of ribs radially spaced about at least a portion of the hub and extending radially outwardly therefrom. Each of the ribs has an outer end and an inner end, the inner end of which is pivotably mounted on the hub to permit movement of the ribs between an open position, in which the outer ends of the ribs are moved laterally away from one another, and a collapsed, closed position, in which the outer ends of the ribs are disposed closely adjacent one another. The shelter also includes a cover material secured to each of the ribs and interconnecting adjacent ones thereof, and locking means for releasably securing the ribs in the open position.

Preferably, the ribs have an arcuate configuration and the shelter additionally includes means for anchoring the shelter to a support. Most advantageously, the ribs comprise cylindrical, hollow rods and the cover material comprises a fabric material.

Most advantageously, the central hub has a multiplicity of radially-spaced holes formed therein adjacent its curved periphery, and the inner ends of the ribs are pivotably received therein. Most desirably, the central hub includes a handle, and the ribs and rods are fabricated from aluminum.

In a preferred embodiment, the locking means comprises at least one locking assembly, including a pair of elongated rods, each having an outer and an inner end. Each of the rods is pivotably secured at its inner end to one of the outermost ribs to permit pivotal movement thereof, between a collapsed position, in which the rods lie generally closely adjacent and parallel to the outermost ribs, and a locking position, in which one of the rods transversely spans several of the inwardly-disposed ribs and the other of the rods transversely spans the remaining inwardly-disposed ribs. Means are also provided for demountably securing the rods to the respective ribs which they span. The assembly further includes means for detachably securing the outer ends of the rods together in the locking position thereof.

Most advantageously, these rods have a generally arcuately-shaped configuration, and the means for detachably securing, includes a female coupling member secured to the outer end of one of the rods and in which the outer end of the other rod is frictionally receivable for effecting detachable securement of the ends of the rods to one another. Most desirably, one of the rods includes pivot joint means interposed between the outer and inner end thereof which permits pivotal movement of the outer end thereof between a retracted position, to, in turn, permit movement of the rod to its collapsed position, and an extended position to, in turn, permit movement of the rod to the locking position thereof.

Other objects and features of the present invention will become apparent from the following detailed description when taken in connection with the accompanying drawings which discloses several embodiments of the invention. It is to be understood that the drawings are designed for the purpose of illustration only, and are not intended as a definition of the limits and scope of the invention disclosed.

In the drawings, wherein similar reference numerals denote similar elements throughout the several views.

Figures 1, 2, 3, 6:
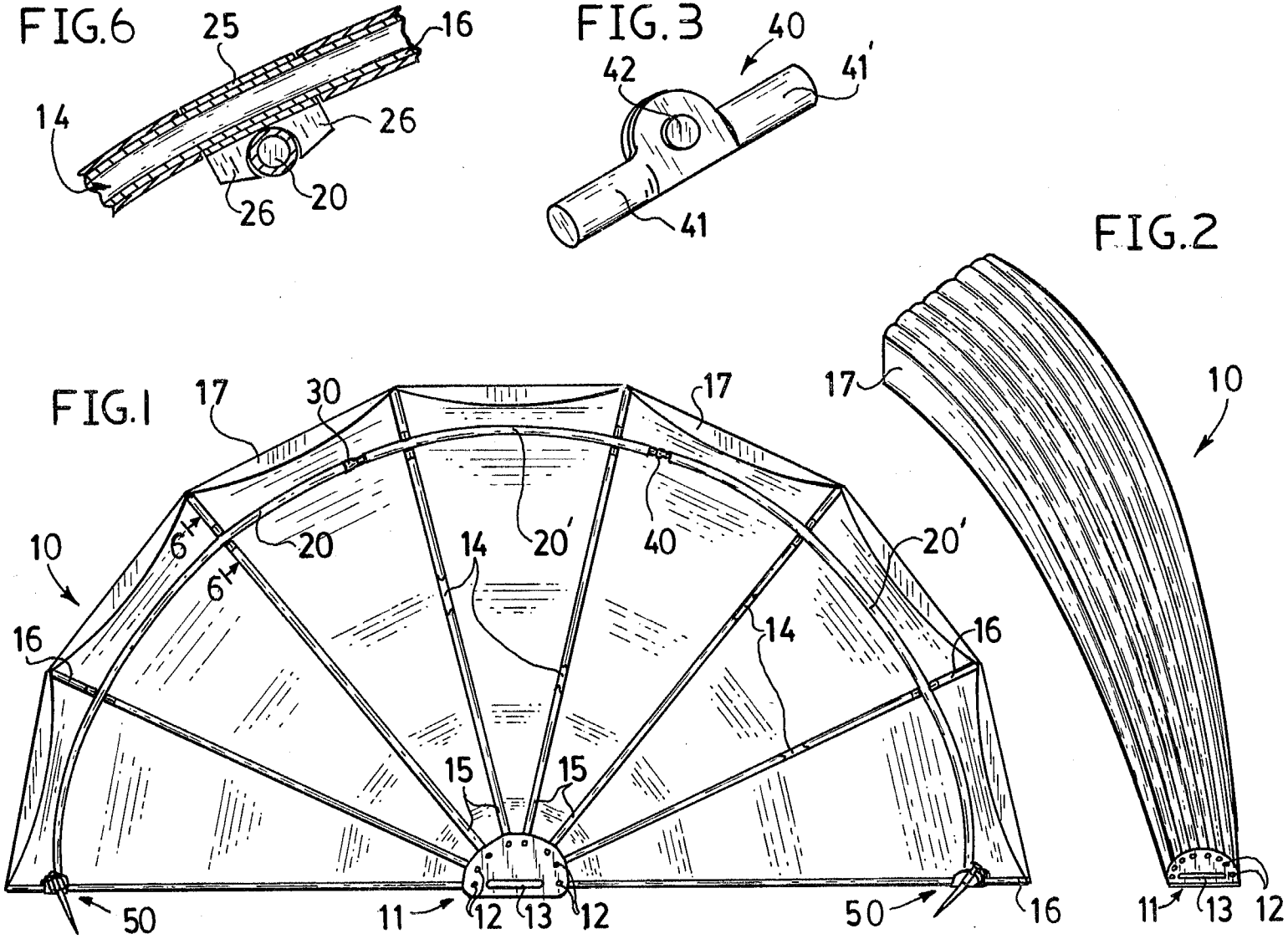
FIG. 1 is a front elevational view of a novel collapsible shelter, embodying the present invention in a fully open position, partly in section.
FIG. 2 is a rear and side perspective view of the shelter in a fully-collapsed position.
FIG. 3 is an enlarged, perspective view of a pivot joint used in the shelter locking assembly.
FIG. 6 is an enlarged, sectional view taken along line 6—6 of FIG. 1.

Turning now in detail to the drawings, therein illustrated is a novel collapsible beach shell or shelter, embodying the present invention, generally designated by the numeral 10. As seen in FIG. 1, the shell includes a generally semicircular, flat, central hub 11 which has a U-shaped cross-section and which has formed in the semicircular arms thereof adjacent to their curved periphery, eight radially and equidistantly spaced holes 12 which are each disposed opposite one of the holes in the other semicircular arm. Adjacent to the rectilinear portion of their periphery, an elongated slot 13 is provided which serves as a handle for carrying shell 10.

Eight generally arcuately-shaped, hollow, cylindrical ribs 14 extend radially outwardly from hub 11, and each has an inner end portion 15, which is pivotably received within one of the paired holes 12 of hub 11. As a result of this pivotable mounting, ribs 14 may be moved between an open position (FIG. 1), in which the outer ends 16 of ribs 14 are moved laterally away from one another to effect a curved, fan-shaped pattern, and a closed, collapsed position (FIG. 2), in which the outer ends 16 of ribs 14 are disposed closely adjacent one another.

A suitable covering material 17, such as a fabric material, is draped over the ribs 14 and is fastened to each one in a suitable manner (not shown). The covering material is of sufficient dimensions such that when the ribs 14 are moved to the open position, covering material 17 is drawn taut.

Shell 10 also includes a releasable locking assembly which includes two elongated, generally arcuately-shaped, hollow cylindrical rods 20,20'. As shown more clearly in FIG. 5, rods 20,20' each have inner end portion 21 which is pivotably secured to one of the two outermost ribs 14, adjacent to its outer end 16 by means of a U-shaped mounting bracket 22 which is clamped onto each of the outermost rods 14. The arms of bracket 22 are each provided with a bore 23 in which a pin 24, which is secured to the inner end 21 of each of rods 20,20', is pivotably received. This permits pivotal movement of rods 20,20' between a collapsed position, in which each of the rods 20,20' transversely span a number of the remaining inwardly-disposed ribs 14. As seen more clearly in FIG. 6, in the latter position, rods 20,20' are demountably secured to the inner ribs 14 by means of a generally cylindrical bracket 25 mounted on each of the inner ribs 14 (adjacent to their outer ends 16), each of which has a pair of spaced-apart flanges 26, which cooperate to grasp the rod therebetween; flanges 26 preferably providing a frictional coupling for rods 20,20'.

Figure 4:
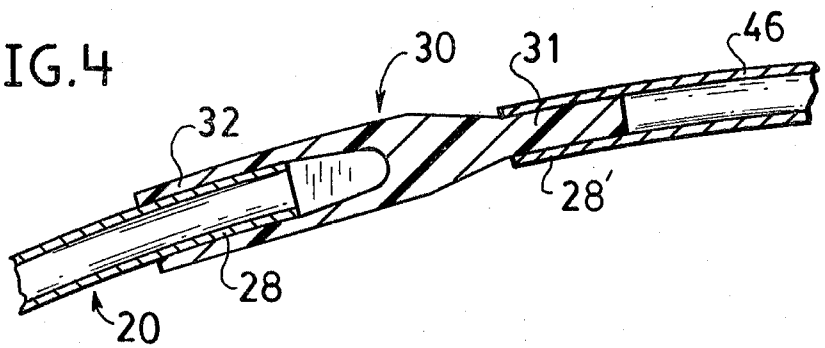
FIG. 4 is an enlarged, fragmentarilly-illustrated sectional view of the shelter locking assembly.

As seen in FIG. 4, the outer ends 28,28' of rods 20,20' are coupled together by means of a coupling member 30. Coupling member 30 has a male inner end portion 31 which is frictionally received within the outer end 28' of rod 20' and, at its opposite end, a cylindrical female outer end portion 32 in which the outer end 28 of rod 20 is frictionally receivable for clamping the two rods 20,20' together.

Rod 20' is also provided with a pivotable joint coupling 40 which, as shown in FIG. 3, includes two arms 41, 41' having a generally b-shaped configuration which are pivotably secured together by means of a pin 42. As illustrated in FIG. 4, rod 20' is split into an outer segment 46 and an inner segment 47 which are pivotably jointed together by means of coupling 40, with one of its arms 41 being received with the inner end portion of the outer segment 46 and the other arm 41 being received within the outer end portion of the inner segment 47. This permits movement of the outer segment 46 relative to the inner segment 47, between a retracted position (not shown) in which it lies substantially adjacent to inner segment 47 and, a fully extended position (FIG. 4), the purpose for which will be described in greater detail hereinafter.

Thus, to open shell 10, the user simply spreads ribs 14 apart in a fan-shaped pattern (ribs 14 pivoting about their inner ends 15). Then, rods 20,20' which normally rest adjacent to and parallel to the outermost ribs 14, are raised (also pivoted about their inner ends 21) and moved into their locking position as shown in FIG. 1, wherein rod 20 transversely spans a number of the inner ribs 14 and rod 20' transversely spans the remaining inner ribs 14, in its fully extended position. Thereafter, the outer end 28 of rod 20 is inserted into outer end portion 32 of coupling member 30 to join the ends 28,28' of the rods 20,20' together. Finally, rods 20,20' are pushed into snap-fit engagement with the flanges 26 of mounting brackets 25, to effect locking of rods 20,20' in a relatively rigid open position; the stretching of the covering material 17 also serving to enhance structural rigidity.

Figure 5:
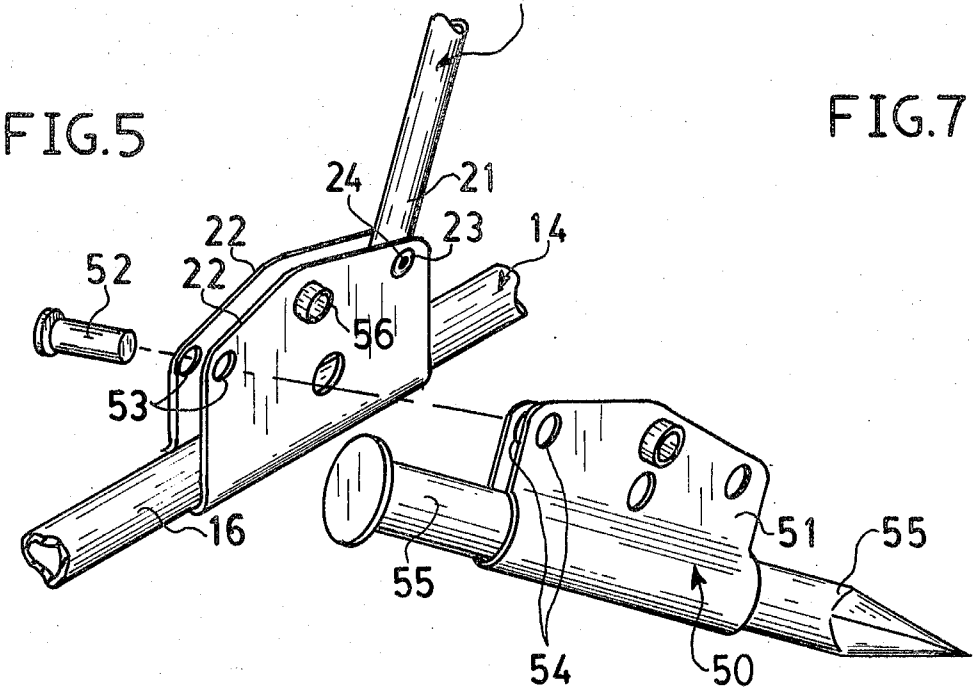
FIG. 5 is an enlarged, exploded view showing the pivotable mounting of one end of the locking assembly and a spike assembly on an outer rib of the shelter.

The opened shell 10 may then be fastened to the ground by means of spike assemblies 50 which, as illustrated in FIG. 5, includes a U-shaped bracket 51 which supports a spike 55 and which is pivotably secured to bracket 22 by suitable means, such as a bolt 52 which extends through bores 53 of bracket 22 and bores 54 of bracket 50 and is held in place at its free end by a fastener (not shown). Bracket 50 and spike 55 are also pivotable between a retracted position (not shown) in which spike 50 lies generally parallel to rib 14, and an extended position (FIG. 1), the latter of which is limited by a stop 56 provided on bracket 22 so as to enhance its holding power.

As can be appreciated, shade is provided simply by turning the shell's back to the sun, thereby casting a shadow within the shell as well as beyond, depending upon the sun's angle. The shell affords relative privacy by establishing a somewhat walled-in environment. One can also have some privacy while sunbathing simply by turning the open end of the shell into the sun. Wind protection is provided when the shell's back or side is directed towards the wind. Also, the shell affords protection against the possibility of having sand kicked in one's face.

To effect collapse of the shell, the procedure would simply be reversed. Rods 20,20' would be removed from engagement with flanges 26 and the outer end 28 of rod 20 would then also be withdrawn from coupling member 30. Then the outer segment 46 of rod 20' would be folded back against inner segment 47 and the two rods would then be moved to their collapsed position in which they lie closely adjacent to the outermost rib to which they are pivotably attached; similarly, the spikes would also be moved to their retracted position. Finally, the outer ends of the ribs would then be pushed together, to collapse the structure, which position is shown in FIG. 2.

With respect to the retraction of rods 20,20', it should be noted that the length of rod 20 and the length of inner segment 47 of rod 20' are determined so that their respective outer ends in the collapsed state thereof, lies adjacent to the inner end 15 of the outer rib 14 to which they are secured; their length being somewhat less than that of ribs 14 due to their mounting inwardly of outer ends 16 of ribs 14. The additional length of rods 20,20' necessary to effect joining of the rods 20,20' together in their open position is provided by outer segment 46 of rod 20'. When it is desired to collapse shell 10, outer segment 46 is folded against inner segment 46 prior to the collapse of rod 20'.

Figure 7:
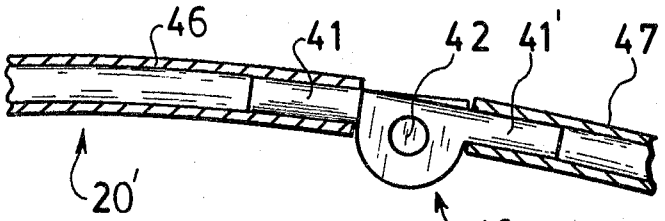
FIG. 7 is a perspective view of an alternate embodiment of the shelter which is provided with a floor covering.
Figure 7:
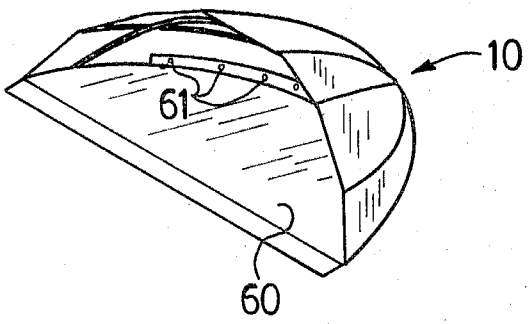
Figure 8:
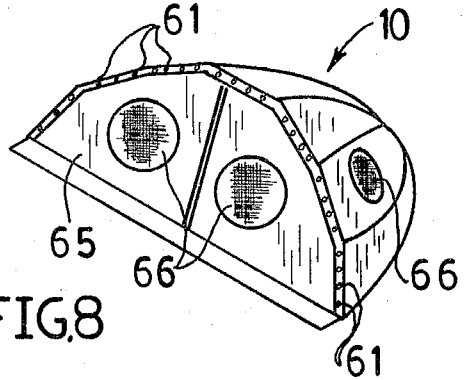
FIG. 8 is a perspective view of another embodiment of the shelter which is provided with a front flap.

As shown in FIG. 7, the shell may be provided with a floor covering 60 which is detachably secured to the shell by suitable means such as snap-fit fasteners 61. In addition, as shown in FIG. 8, the shell could also have a detachably secured zippered front flap 65 which would also be secured to the shell or fabric covering by means of snap-fit fasteners 61. Flap 65, as well as the shell 10, could also be provided with plastic windows 66. Such an equipped shell would be ideally suited for camping.

While the instant invention has been described in relation to the illustrated and preferred embodiment, it should be understood that modifications may be made as will be apparent to those skilled in the art. For instance, the size, shape, and number of ribs and locking assemblies employed may be varied. In addition, although the ribs and rods are preferably fabricated from lightweight aluminum, other suitable materials may be employed. Finally, it may also be possible to provide for folding of the individual ribs after they have been collapsed, to provide a more compact and easily transported and stored construction.

Thus, it can be seen that the present invention provides a novel collapsible shelter which affords privacy and protection against the wind and sun, and which is lightweight, portable and easy to install. The shelter is of relatively simple design, inexpensive, durable, and reliable in operation. In addition, the shelter is especially suitable for use at the beach, camping facilities, or swimming pool decks, terraces, and the like.

What is claimed is:

1. A collapsible shelter comprising:

a central hub;

a multiplicity of ribs radially spaced about at least a portion of said hub and extending radially outwardly therefrom, each of said ribs having an outer end and an inner end, the inner end of which is pivotably mounted on said hub to permit movement of said ribs between an open position, in which the outer end of the ribs are moved laterally away from one another, and a collapsed, closed position in which the outer ends of said ribs are disposed closely adjacent one another; a cover material secured to each of said ribs and interconnecting adjacent ones thereof; and locking means for releasably securing said ribs in said open position, said locking means comprising at least one locking assembly, including a pair of elongated rods, each having an outer and an inner end, and each of which is pivotably secured at its inner end to one of the outermost ribs to permit pivotal movement thereof, between a collapsed position, in which said rods lie generally closely adjacent, and parallel, to said outermost ribs, and a locking position, in which one of said rods transversely spans several of the inwardly-disposed ribs and the other of said rods transversely spans the remaining inwardly-disposed ribs, means for demountably securing said rods to the respective ribs which they span, and means for detachably securing the outer ends of said rods together in said locking position thereof.

2. The shelter according to claim 1, wherein said ribs have an arcuate configuration.

3. The shelter according to claim 1, wherein said shelter additionally comprises means for anchoring said shelter to a support.

4. The shelter according to claim 1, wherein said ribs comprise cylindrical hollow rods.

5. The shelter according to claim 1, wherein said cover material comprises a fabric material.

6. The shelter according to claim 1, wherein said central hub has a generally semi-circular, flat configuration and has a multiplicity of radially-spaced holes formed therein adjacent its curved periphery and said inner ends of said ribs are pivotably received therein.

7. The shelter according to claim 1, wherein said central hub includes a handle.

8. The shelter according to claim 1, wherein said ribs and rods are fabricated from aluminum.

9. The shelter according to claim 1, wherein said rods have a generally arcuately-shaped configuration.

10. The shelter according to claim 1, wherein said means for detachably securing comprises a female coupling member secured to the outer end of one of said rods and in which the outer end of the other rod is frictionally receivable for effecting detachable securement of the ends of the rods to one another.

11. The shelter according to claim 10, wherein one of said rods includes pivot joint means interposed between the outer and inner end thereof which permits pivotal movement of the outer end thereof between a retracted position, to in turn permit movement of said rod to said collapsed position, and an extended position, to in turn permit movement of said rod to said locking position.

* * * * *